US010989488B2

(12) United States Patent
Delgado Acarreta et al.

(10) Patent No.: US 10,989,488 B2
(45) Date of Patent: Apr. 27, 2021

(54) SAFETY DEVICE FOR FIREARMS AND SAFETY METHOD FOR FIREARMS

(71) Applicant: RADE TECNOLOGÍAS, S.L., Saragossa (ES)

(72) Inventors: Raúl Delgado Acarreta, Saragossa (ES); Daniel Osuna Sanz, Saragossa (ES); Eduardo Santesteban de la Concepción, Saragossa (ES); Pedro Morales Sánchez, Saragossa (ES)

(73) Assignee: RADE TECNOLOGÍAS, S.L., Saragossa (ES)

( * ) Notice: Subject to any disclaimer, the term of this patent is extended or adjusted under 35 U.S.C. 154(b) by 0 days.

(21) Appl. No.: 16/254,132

(22) Filed: Jan. 22, 2019

(65) Prior Publication Data

US 2019/0226785 A1 Jul. 25, 2019

(30) Foreign Application Priority Data

Jan. 22, 2018 (EP) ..... 18382031

(51) Int. Cl.

| | |
|---|---|
| ***F41A 17/30*** | (2006.01) |
| ***F41A 17/46*** | (2006.01) |
| ***F41A 17/74*** | (2006.01) |
| ***F41A 17/06*** | (2006.01) |
| ***F41A 17/26*** | (2006.01) |

(52) U.S. Cl.

CPC ..... *F41A 17/30* (2013.01); *F41A 17/06* (2013.01); *F41A 17/26* (2013.01); *F41A 17/46* (2013.01); *F41A 17/74* (2013.01)

(58) Field of Classification Search

CPC ..... F41A 17/46; F41A 17/56; F41A 17/74
USPC ..... 42/70.01, 70.04, 70.05, 70.08
See application file for complete search history.

(56) References Cited

U.S. PATENT DOCUMENTS

| | | | | | |
|---|---|---|---|---|---|
| 1,416,671 | A | * | 5/1922 | Artamendi | F41A 17/26 89/137 |
| 3,292,492 | A | * | 12/1966 | Sturtevant | F41A 19/02 89/128 |
| 4,450,751 | A | * | 5/1984 | Thevis | F41A 17/46 89/129.02 |
| 4,671,005 | A | * | 6/1987 | Jewell | F41A 17/46 42/69.02 |
| 5,022,175 | A | * | 6/1991 | Oncke | F41A 17/04 42/66 |
| 5,068,990 | A | * | 12/1991 | Marzocco | F41A 17/56 42/70.04 |

(Continued)

FOREIGN PATENT DOCUMENTS

WO 1997/021974 6/1997

*Primary Examiner* — Derrick R Morgan
(74) *Attorney, Agent, or Firm* — Carmody Torrance Sandak & Hennessey LLP

(57) ABSTRACT

The present invention relates to a safety device for firearms that enables providing additional safety to the original safety of the weapon itself, such that safety conditions prevail in either of the two systems, the original safety of the weapon or the additional safety device object of the present invention, such that if either of the two is in safe or in locked position, the firearm is in safe or locked position, the safety device for firearms being configured to be implemented in a new firearm or an existing firearm, wherein the invention further relates to a safety method for firearms.

17 Claims, 5 Drawing Sheets

(56) References Cited

U.S. PATENT DOCUMENTS 5,109,622 A * 5/1992 Echeberria ..... F41A 17/46 42/51
5,417,001 A * 5/1995 Rousseau ..... F41A 17/30 42/69.03
5,448,847 A 9/1995 Teetzel
5,713,150 A * 2/1998 Ealovega ..... F41A 19/46 42/84
6,289,619 B1 * 9/2001 Fuchs ..... F41A 19/14 42/69.03
6,442,880 B1 * 9/2002 Allan ..... F41A 17/066 42/66
6,463,689 B1 * 10/2002 McElroy ..... F41A 17/02 42/70.08
6,510,639 B2 * 1/2003 McMoore ..... F41A 17/20 42/70.06
6,543,170 B2 * 4/2003 Beretta ..... F41A 17/74 42/70.08
6,615,527 B1 * 9/2003 Martin ..... F41A 19/46 42/20
6,907,813 B2 * 6/2005 Gablowski ..... F41A 17/32 42/70.04
7,051,468 B2 * 5/2006 Glock ..... F41A 17/02 42/70.01
8,215,048 B2 * 7/2012 Summers ..... F41A 17/063 42/70.06
8,336,438 B2 * 12/2012 Compton ..... F41A 19/66 89/132
8,677,665 B1 * 3/2014 Huber ..... F41A 19/12 42/69.01
8,807,007 B2 * 8/2014 Alicea ..... F41A 17/06 89/28.1
9,046,313 B1 6/2015 Lutton et al.
9,441,896 B2 * 9/2016 Allan ..... F41A 17/46
10,337,818 B1 * 7/2019 Sampson, Jr. ..... F41A 19/33
2001/0054246 A1 * 12/2001 Guhring ..... F41A 19/16 42/69.03
2009/0107024 A1 * 4/2009 Doll ..... F41A 17/42 42/70.01
2013/0118050 A1 * 5/2013 Alicea ..... F41A 17/06 42/84
2013/0167423 A1 * 7/2013 Lupher ..... F41A 17/06 42/70.06
2014/0196341 A1 * 7/2014 Tasyagan ..... F41A 17/56 42/69.01
2014/0305017 A1 * 10/2014 Travis ..... F41A 17/063 42/70.06
2015/0168091 A1 * 6/2015 Doll ..... F41A 17/46 42/69.01
2016/0084599 A1 * 3/2016 Alicea, Jr. ..... F41A 17/46 42/70.06
2016/0084601 A1 * 3/2016 Alicea, Jr. ..... F41A 17/20 42/6
2016/0202009 A1 7/2016 Olivas, Jr.
2016/0327356 A1 11/2016 Milde, Jr. et al.
2017/0089656 A1 * 3/2017 Alicea, Jr. ..... F41A 19/59
2017/0276447 A1 * 9/2017 Foster ..... F41A 19/10
2018/0087860 A1 * 3/2018 Sullivan ..... F41A 17/46
2018/0224231 A1 * 8/2018 Weinberg ..... F41A 17/46
2019/0226785 A1 * 7/2019 Delgado Acarreta ... F41A 17/06
2020/0025488 A1 * 1/2020 Alicea, Jr. ..... F41A 19/69

* cited by examiner

SAFETY DEVICE FOR FIREARMS AND SAFETY METHOD FOR FIREARMS

OBJECT OF THE INVENTION

The present invention relates to a safety device for firearms that enables providing additional safety to the original safety of the weapon itself, such that safety conditions prevail in either of the two systems, the original safety of the weapon or the additional safety device object of the present invention, such that if either is in safe or in locked position, the firearm is in safe or locked position.

The safety device for firearms is configured to be implemented in a new firearm or an existing firearm.

The invention further relates to a safety method for firearms.

BACKGROUND OF THE INVENTION

Safety devices for firearms are known in the state of the art and these comprise a safety that can be actuated by means of a lever accessible to the user, which enables establishing at least two positions: at least one first firing position and one second locking position.

By means of this safety, when the lever accessible to the user is arranged in firing position, the trigger is released, which makes the actuation thereof possible in order to release the hammer from the retention to which it is subjected and carry out firing because of the energy stored in the spring to which the hammer is joined.

Among the above, both semiautomatic model Colt AR 15 and the equivalent thereof, U.S. Army automatic model M16 can be found, wherein the trigger prevents the weapon from firing accidentally. However, occasionally, the user may inadvertently actuate the trigger while the safety is in the firing position, which would result in an accidental shot.

The safety device for firearms of the present invention represents additional safety to the safety measures described above, which doubles the safety of the firearm and prevents unforeseen shots from being fired.

DESCRIPTION OF THE INVENTION

The present invention relates to a safety device for firearms that enables providing additional safety to the original safety of the weapon itself, such that safety conditions prevail in either of the two systems, the original safety of the weapon or the additional safety device object of the present invention, such that if either is in safe or in locked position, the firearm is in safe or locked position.

The safety device for firearms is arranged in a firearm, wherein the firearm comprises:

- a first safety that can be actuated by the user of the firearm, the first safety configured to be arranged in at least two positions: at least one first firing position and one first locking position;
- a trigger configured to be released when the first safety that can be actuated by the user of the firearm is in the at least first firing position;
- a hammer configured to be released when the trigger is actuated or kept actuated in the at least first firing position;

wherein the safety device for firearms comprises:

- a second safety configured to lock the hammer in at least the at least first firing position, corresponding to a second locking position of said second safety.

Optionally, the second safety is also configured to be arranged in at least two positions, a second firing position corresponding to the at least first firing position of the first safety or to the first locking position of the first safety and the second locking position corresponding to the at least first firing position or to the first locking position of the first safety. That is, the second safety can be arranged in at least two positions, the second locking position wherein firing is prevented regardless of whether the first safety is in the at least first firing position or in the first locking position, and a second firing position wherein firing is enabled when the first safety is in the at least first firing position.

Optionally, the second safety comprises a cam, wherein in the second firing position, the cam is joined to the trigger and in the second locking position, the cam is not joined to the trigger, such that although the trigger is pulled in the second locking position, either the trigger or the cam locks the hammer in the at least first firing position or in the first locking position of the first safety.

Optionally, the second safety further comprises a locking bolt configured to make the cam pass from the second firing position where it is joined to the trigger, to the second locking position where it is not joined to the trigger or vice versa.

Optionally, the safety device further comprises a disconnection device configured to retain the hammer.

Optionally, the second safety is configured to be controlled by the user of the firearm, preferably mechanically or electronically.

Also optionally, the second safety is configured to be controlled by a user other than the firearm user.

Optionally, the firearm comprising the safety device described above is a new firearm.

Also optionally, the firearm comprising the safety device described above is a modified firearm.

The invention also relates to a safety method for firearms, wherein the firearm comprises:

- a first safety that can be actuated by the user of the firearm, the first safety configured to be arranged in at least two positions, at least one first firing position and one first locking position;
- a trigger configured to be released when the first safety that can be actuated by the user of the firearm is in the at least first firing position;
- a hammer configured to be released when the trigger is actuated or kept actuated in the at least first firing position;

wherein the safety method for firearms comprises:

- a stage for locking the hammer, wherein hammer locking is carried out in at least the at least first firing position, corresponding to a second locking position of a second safety.

Optionally, in the stage for locking the hammer, the second safety is also configured to be arranged in at least two positions, a second firing position corresponding to the at least first firing position or to the first locking position of the first safety and a second locking position corresponding to the at least first firing position or to the first locking position.

Optionally, the stage for locking the hammer, wherein hammer locking is carried out in the at least first firing position, corresponding to the second locking position of the second safety, is carried out such that either the trigger or a cam of the second safety locks the hammer in the at least first firing position or in the first locking position of the first safety, wherein in the second firing position, the cam is joined to the trigger and in the second locking position, the cam is not joined to the trigger.

Optionally, the stage for locking the hammer, wherein hammer locking is carried out in the at least first firing position corresponding to the second locking position of the second safety, comprises a substage wherein a locking bolt of the second safety makes the cam pass from the second firing position where it is joined to the trigger, to the second locking position where it is not joined to the trigger or vice versa.

PREFERRED EMBODIMENT OF THE INVENTION

Figure 1:
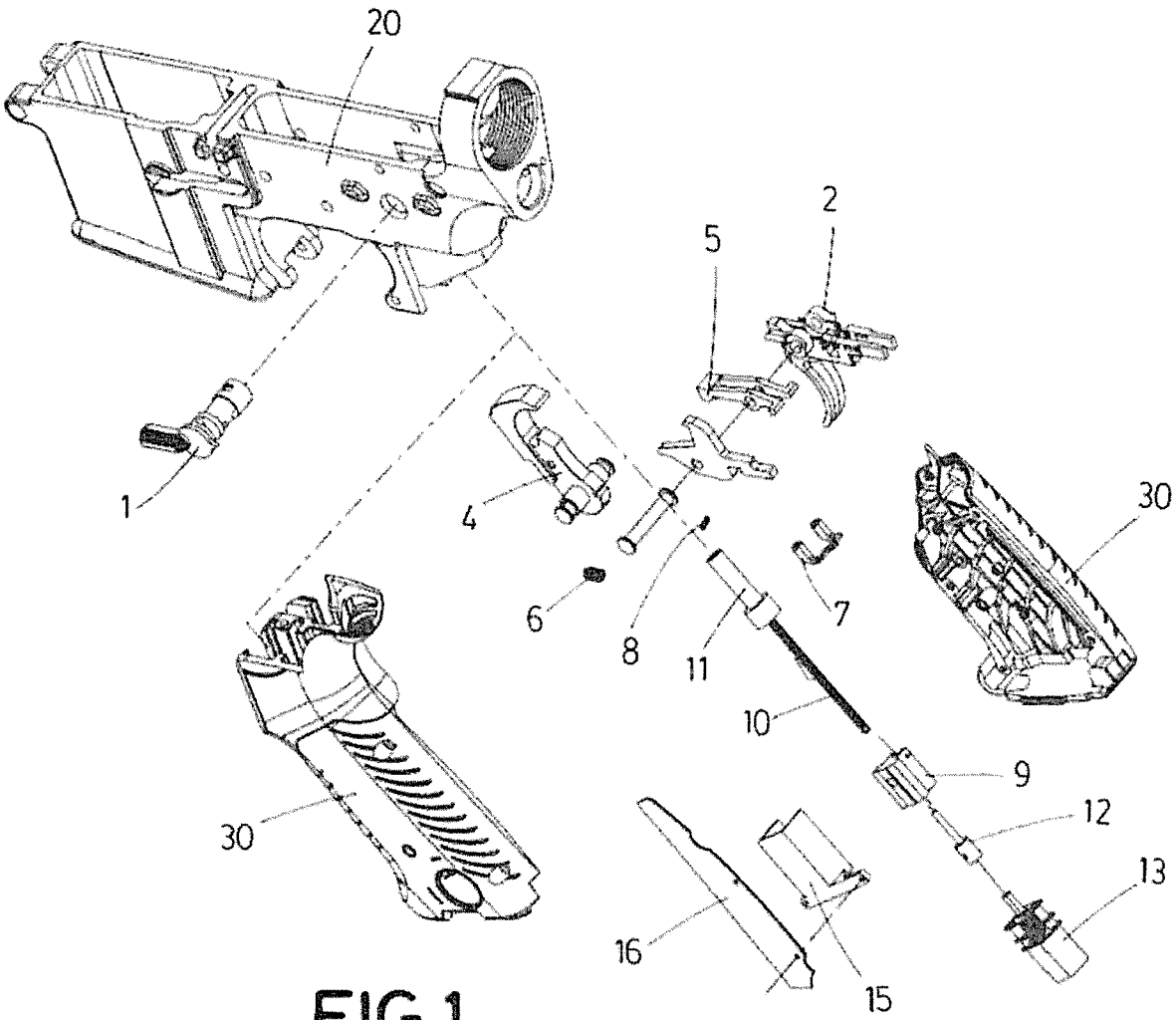
FIG. 1 shows an exploded perspective view of the safety device for firearms of the present invention.
Figure 2:
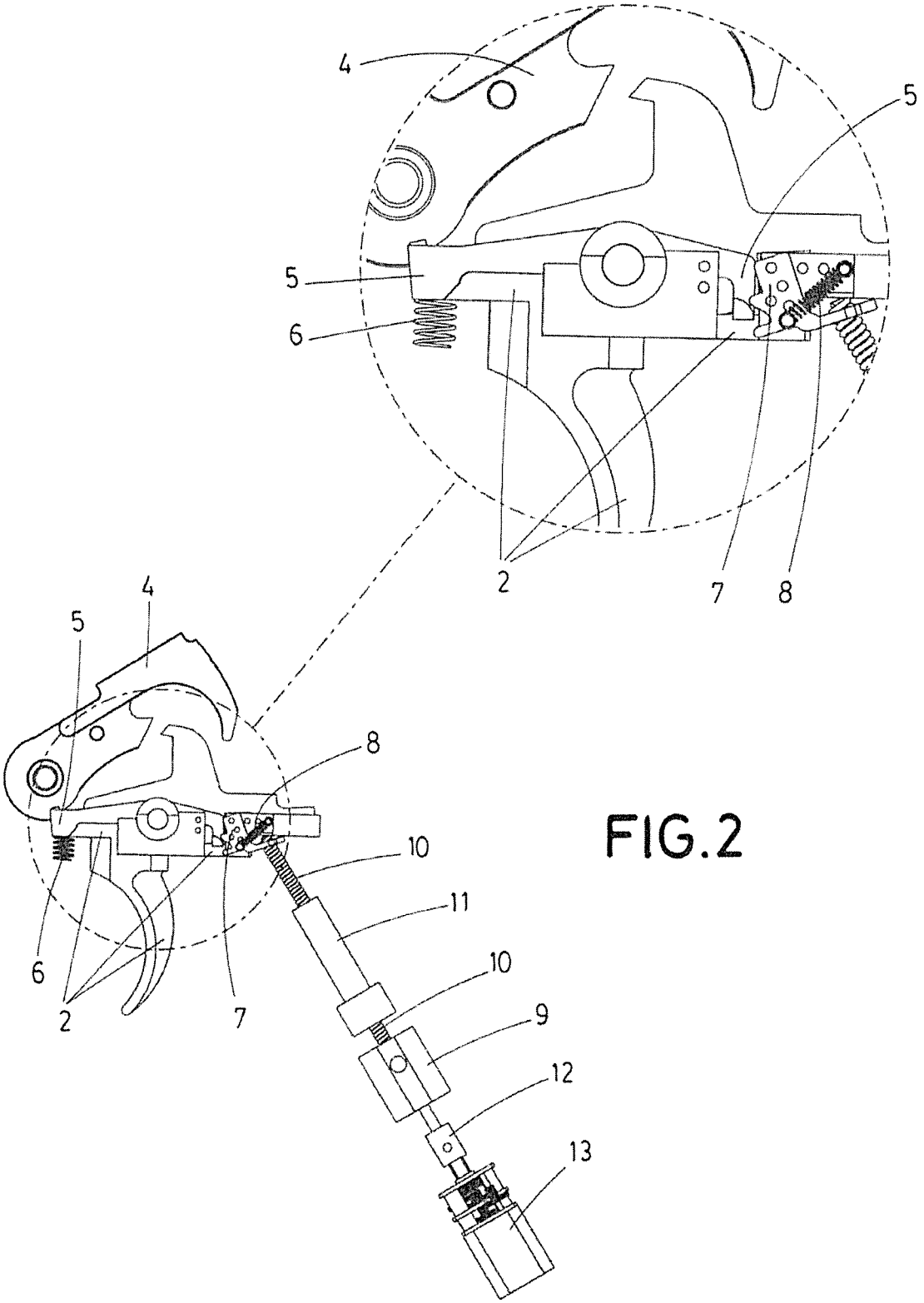
FIG. 2 shows an elevation view of the safety device for firearms of the present invention in the second locking position of the second safety and in which the trigger is not actuated, according to a first exemplary embodiment, wherein a detail of the locking bolt and the cam of the safety device are also shown.
Figure 3:
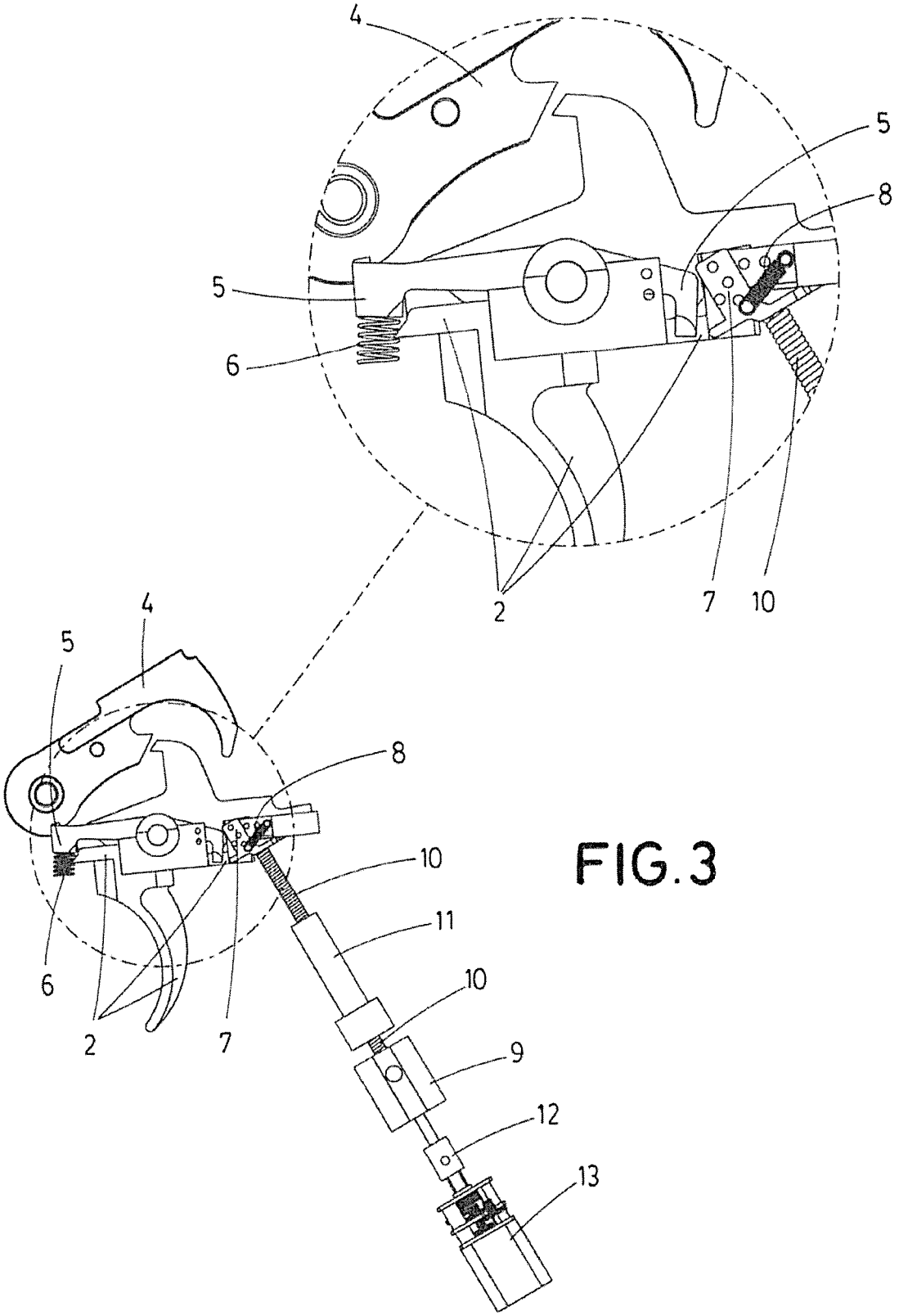
FIG. 3 shows an elevation view of the safety device for firearms of the present invention in the second locking position of the second safety and in which the trigger is actuated, according to the first exemplary embodiment, wherein a detail of the locking bolt and the cam of the safety device are also shown.
Figure 4:
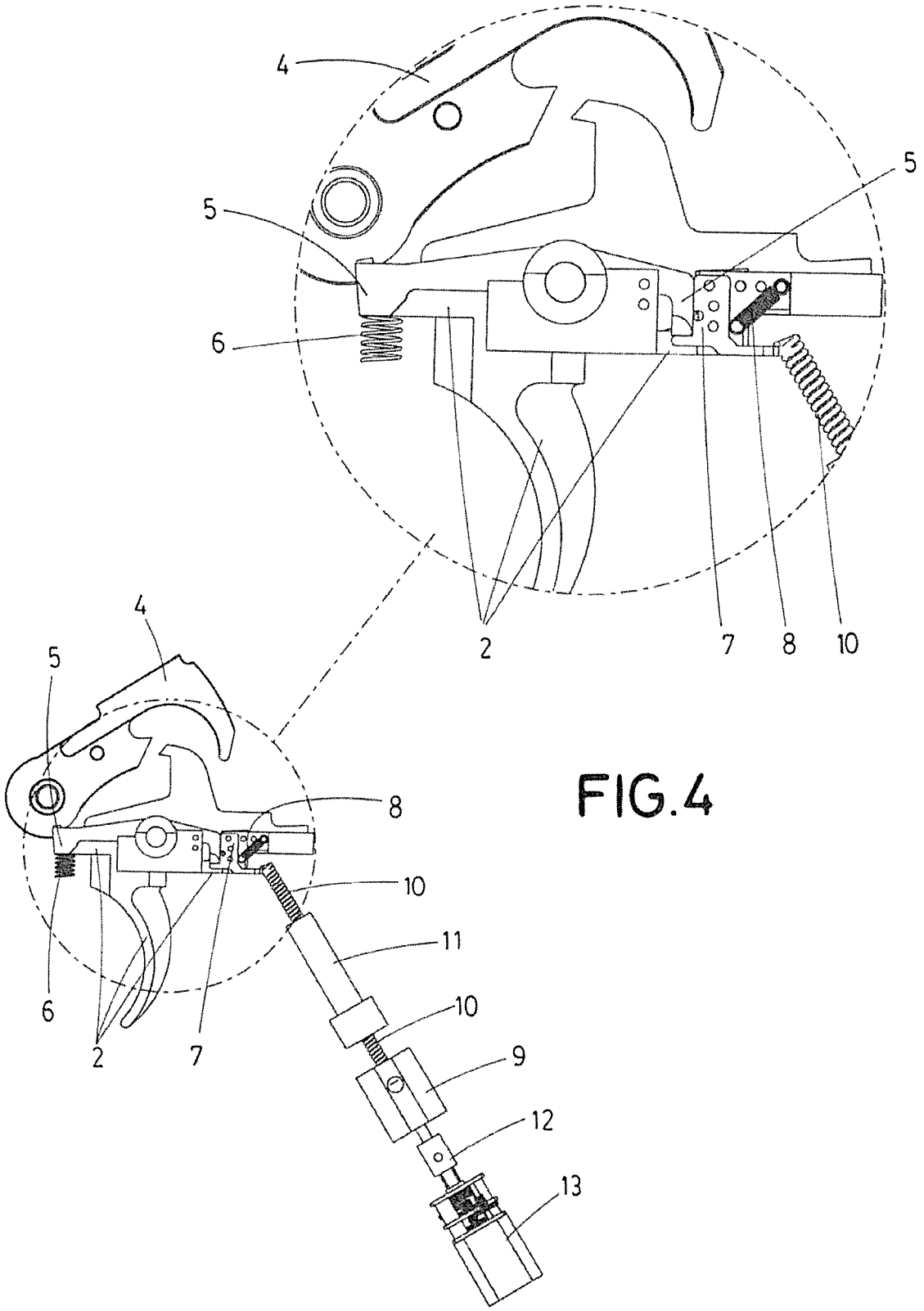
FIG. 4 shows an elevation view of the safety device for firearms of the present invention in the second firing position of the second safety and in which the trigger is not actuated, according to the first exemplary embodiment, wherein a detail of the locking bolt and the cam of the safety device are also shown.
Figure 5:
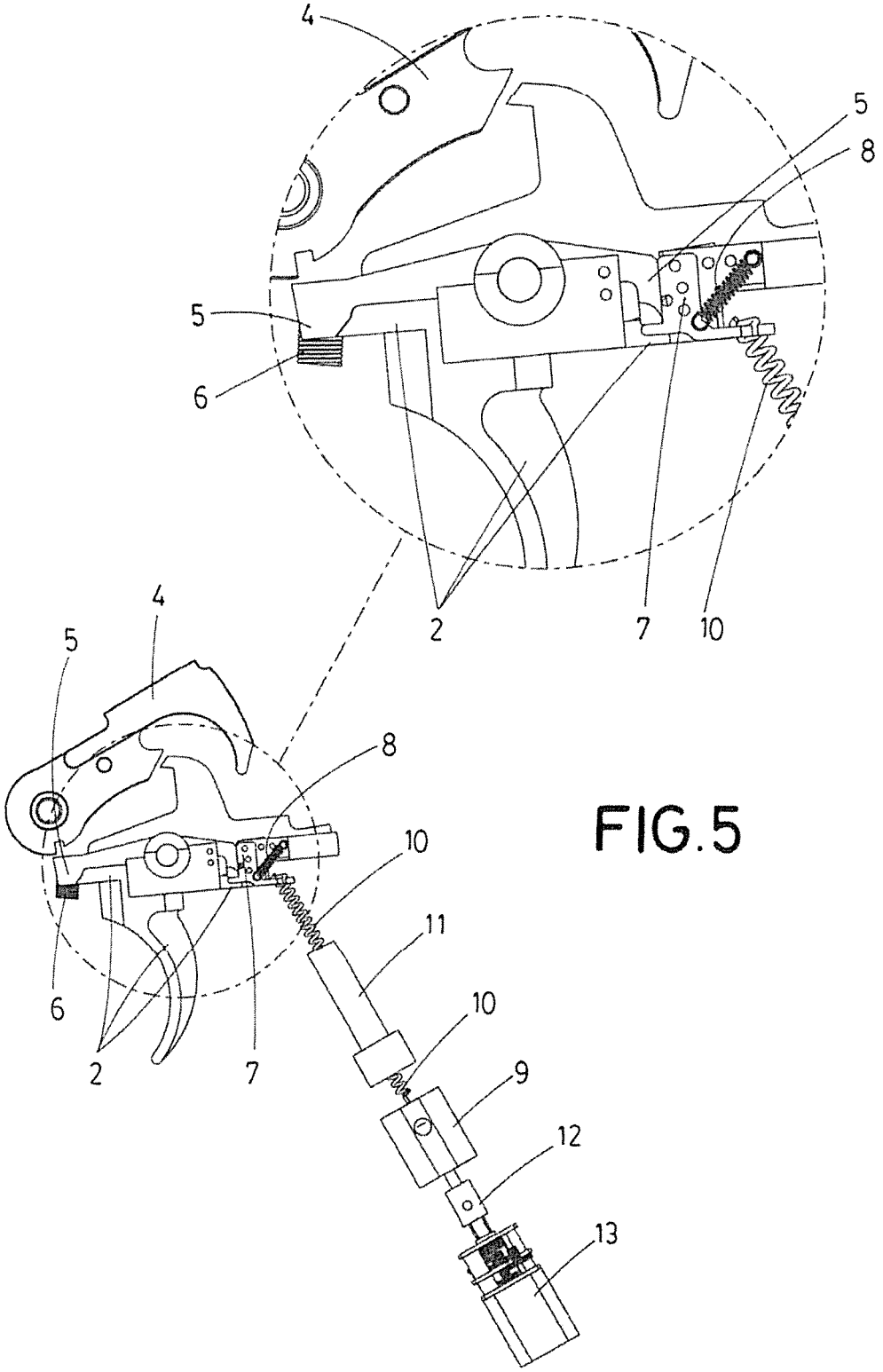
FIG. 5 shows an elevation view of the safety device for firearms of the present invention in the second firing position of the second safety and in which the trigger is actuated, according to the first exemplary embodiment, wherein a detail of the locking bolt and the cam of the safety device are also shown.

A detailed description of the safety device for firearms and the safety method for firearms of the present invention follows here below.

The safety device for firearms is arranged in a firearm, wherein the firearm comprises:

- a first safety (1) that can be actuated by the user of the firearm, configured to be arranged in at least two positions, at least one first firing position and one first locking position;
- a trigger (2) configured to be released when the first safety (1) that can be actuated by the user of the firearm is in the at least first firing position;
- a hammer (4) configured to be released when the trigger (2) is actuated or kept actuated in the at least first firing position;

wherein the safety device for firearms comprises:
- a second safety (5, 6, 7, 8, 9, 10, 11, 12, 13, 15, 16) configured to lock the hammer (4) in at least the at least first firing position, corresponding to a second locking position of said second safety (5, 6, 7, 8, 9, 10, 11, 12, 13, 15, 16).

The second safety (5, 6, 7, 8, 9, 10, 11, 12, 13, 15, 16) is also configured to be arranged in at least two positions, a second firing position corresponding to the at least first firing position of the first safety (1) or to the first locking position of the first safety (1) and the second locking position corresponding to the at least first firing position or to the first locking position of the first safety (1).

The second safety (5, 6, 7, 8, 9, 10, 11, 12, 13, 15, 16) comprises a cam (5), wherein in the second firing position, the cam (5) is joined to the trigger (2) and in the second locking position, the cam (5) is not joined to the trigger (2), such that although the trigger (2) is pulled in the second locking position, either the trigger (2) or the cam (5) locks the hammer (4) in the at least first firing position or in the first locking position of the first safety (1).

The second safety (5, 6, 7, 8, 9, 10, 11, 12, 13, 15, 16) further comprises a first elastic element (6) arranged between a frame (20) of the weapon and the cam (5), the first elastic element (6) being configured to arrange the cam (5) in the second locking position.

The second safety (5, 6, 7, 8, 9, 10, 11, 12, 13, 15, 16) further comprises a locking bolt (7) configured to make the cam (5) pass from the second firing position where it is joined to the trigger (2), to the second locking position where it is not joined to the trigger (2), or vice versa.

The second safety (5, 6, 7, 8, 9, 10, 11, 12, 13, 15, 16) further comprises a second elastic element (8) joined to the locking bolt (7) and arranged between the trigger (2) and the locking bolt (7), which enables carrying out relative displacement between the locking bolt (7) and the trigger (2).

The second safety (5, 6, 7, 8, 9, 10, 11, 12, 13, 15, 16) further comprises a pusher (9) and a third elastic element (10), wherein the third elastic element (10) joins the locking bolt (7) to the pusher (9) and is configured to displace the locking bolt (7) from a first position of the locking bolt (7) corresponding to the second firing position, wherein the cam (5) is joined to the trigger (2), to a second position of the locking bolt (7) corresponding to the second locking position, wherein the cam (5) is not joined to the trigger (2), or vice versa.

The third elastic element (10) is configured to displace the locking bolt (7) from the second position of the locking bolt (7) to the first position of the locking bolt (7), because the pusher (9) expands the third elastic element (10) from a second position of the third elastic element (10) corresponding to the second position of the locking bolt (7), corresponding in turn to the second locking position, wherein the cam (5) is not joined to the trigger (2), to a first position of the third elastic element (10) corresponding to the first position of the locking bolt (7), corresponding in turn to the second firing position, wherein the cam (5) is joined to the trigger (2), or vice versa.

The second safety (5, 6, 7, 8, 9, 10, 11, 12, 13, 15, 16) further comprises an actuator (12, 13), which carries out the expansion of the third elastic element (10) from the second position of the third elastic element (10) to the first position of the third elastic element (10), or vice versa. Preferably, the actuator (12, 13) comprises a spindle (12) joined to a motor (13), wherein the spindle (12) transforms the rotating movement of the motor (13) into a linear movement, and wherein the spindle (12) is joined to the pusher (9), and consequently carries out the expansion of the third elastic element (10) from the second position of the third elastic element (10) to the first position of the third elastic element (10), or vice versa.

The second safety (5, 6, 7, 8, 9, 10, 11, 12, 13, 15, 16) optionally further comprises guiding means (11) configured to guide the third elastic element (10) from the first position of the third elastic element (10) to the second position of the third elastic element (10), or vice versa.

The second safety (5, 6, 7, 8, 9, 10, 11, 12, 13, 15, 16) optionally further comprises a support element (15) of the motor (13), which fastens the motor (13) to the firearm, preferably to a grip (30) of the firearm.

The second safety (5, 6, 7, 8, 9, 10, 11, 12, 13, 15, 16) optionally further comprises a printed circuit board (16), which controls the actuation of the motor (13).

In this exemplary embodiment, at least the third elastic element (10), the guiding means (11), the spindle (12), the pusher (9), the motor (13), the support element (15) of the motor (13) and the printed circuit board (16) are at least partially arranged in the grip (30) of the firearm.

In this exemplary embodiment, the at least one firing position of the device of the present invention comprises a first firing position corresponding to a single cartridge shot and a second firing position corresponding to a shot from a burst of cartridges.

The safety method for firearms, wherein the firearm comprises:

a first safety (1) that can be actuated by the user of the firearm, configured to be arranged in at least two positions, at least one first firing position and one first locking position;

a trigger (2) configured to be released when the first safety (1) that can be actuated by the user of the firearm is in the at least first firing position;

a hammer (4) configured to be released when the trigger (2) is actuated or kept actuated in the at least first firing position;

wherein the safety method for firearms comprises:

a stage for locking the hammer (4), wherein hammer (4) locking is carried out in at least the at least first firing position, corresponding to a second locking position of a second safety (5, 6, 7, 8, 9, 10, 11, 12, 13, 15, 16).

In the stage for locking the hammer (4), the second safety (5, 6, 7, 8, 9, 10, 11, 12, 13, 15, 16) is also configured to be arranged in at least two positions, a second firing position corresponding to the at least first firing position or to the first locking position of the first safety (1) and a second locking position corresponding to the at least first firing position or to the first locking position.

In this preferred exemplary embodiment, the stage for locking the hammer (4), wherein hammer (4) locking is carried out in the at least first firing position corresponding to the second locking position of the second safety, is carried out such that either the trigger (2) or a cam (5) of the second safety (5, 6, 7, 8, 9, 10, 11, 12, 13, 15, 16) locks the hammer (4) in the at least first firing position or in the first locking position of the first safety (1), wherein in the second firing position, the cam (5) is joined to the trigger (2) and in the second locking position, the cam (5) is not joined to the trigger (2).

The stage for locking the hammer (4), wherein hammer (4) locking is carried out in the at least first firing position corresponding to the second locking position of the second safety (5, 6, 7, 8, 9, 10, 11, 12, 13, 15, 16), comprises a substage wherein a locking bolt (7) of the second safety (5, 6, 7, 8, 9, 10, 11, 12, 13, 15, 16) makes the cam (5) pass from the second firing position where it is joined to the trigger (2), to the second locking position where it is not joined to the trigger (2), or vice versa.

The substage wherein the locking bolt (7) of the second safety (5, 6, 7, 8, 9, 10, 11, 12, 13, 15, 16) makes the cam (5) pass from the second firing position where it is joined to the trigger (2), to the second locking position where it is not joined to the trigger (2), or vice versa, is carried out by means of a rotation of the locking bolt (7) with linear actuation of said locking bolt (7).

The invention claimed is:

1. A safety device for firearms, which is arranged in a firearm, wherein the firearm comprises:

a first safety that can be actuated by the user of the firearm, configured to be arranged in at least two positions: at least one first firing position and one first locking position;

a trigger that can be actuated by the user of the firearm configured to be released when the first safety is in the at least first firing position;

a hammer configured to be released when the trigger is actuated or kept actuated and the first safety is in the at least first firing position; and a second safety that can be arranged in at least two positions, a second locking position and a second firing position, the second safety comprises a cam and a locking bolt, wherein:

in the second firing position the locking bolt is pressed against the cam and the cam is interlocked with the trigger, such that actuation of trigger releases the hammer; and in the second locking position the locking bolt is not pressed against the cam and the cam is not interlocked with the trigger, such that the hammer is locked by the trigger or the cam regardless of the position of the first safety.

2. A safety device for firearms according to claim 1, wherein in the second locking position of the second safety firing is prevented regardless of whether the first safety is in the at least first firing position or in the first locking position, and in the a second firing position firing is enabled when the first safety is in the at least first firing position.

3. A safety device for firearms according to claim 1, wherein the second safety further comprises a first elastic element arranged between a frame of the weapon and the cam, the first elastic element being configured to arrange the cam in the second locking position.

4. A safety device for firearms according to claim 3, wherein the second safety further comprises a pusher and a third elastic element, wherein the third elastic element joins the locking bolt to the pusher and is configured to displace the locking bolt from a first position of the locking bolt corresponding to the second firing position, wherein the cam is interlocked with the trigger, to a second position of the locking bolt corresponding to the second locking position, wherein the cam is not interlocked with the trigger, or vice versa.

5. A safety device for firearms according to claim 4, wherein the second safety further comprises a second elastic element joined to the locking bolt and arranged between the trigger and the locking bolt, which enables carrying out relative displacement between the locking bolt and the trigger.

6. A safety device for firearms according to claim 5, wherein the third elastic element is configured to displace the locking bolt from the second position of the locking bolt to the first position of the locking bolt, because the pusher expands the third elastic element from a second position of the third elastic element corresponding to the second position of the locking bolt, corresponding in turn to the second locking position, wherein the cam is not interlocked with the trigger, to a first position of the third elastic element corresponding to the first position of the locking bolt, corresponding in turn to the second firing position, wherein the cam is interlocked with the trigger, or vice versa.

7. A safety device for firearms according to claim 6, wherein the second safety further comprises an actuator, which carries out the expansion of the third elastic element from the second position of the third elastic element to the first position of the third elastic element, or vice versa.

8. A safety device for firearms according to claim 7, wherein the actuator comprises a spindle joined to a motor, the spindle transforming the rotating movement of the motor into a linear movement, and wherein the spindle is joined to the pusher, and consequently carries out the expansion of the third elastic element from the second position of the third elastic element to the first position of the third elastic element, or vice versa.

9. A safety device for firearms according to claim 8, wherein the second safety is configured to be controlled by the user of the firearm, either mechanically or electronically.

10. A safety device for firearms according to claim 7, wherein the second safety is configured to be controlled by a user other than the firearm user.

11. A safety device for firearms according to claim 7, wherein the second safety is configured to be controlled by the user of the firearm, either mechanically or electronically.

12. A safety device for firearms according to claim 8, wherein the second safety is configured to be controlled by a user other than the firearm user.

13. A safety device for firearms according to claim 1, wherein the second safety is configured to be controlled by the user of the firearm, either mechanically or electronically.

14. A safety device for firearms according to claim 1, wherein the second safety is configured to be controlled by a user other than the firearm user.

15. A safety device for firearms according to claim 1, wherein the second safety further comprises a first elastic element arranged between a frame of the weapon and the cam, the first elastic element being configured to arrange the cam in the second locking position;

the second safety further comprising a pusher and a third elastic element, the third elastic element joining the locking bolt to the pusher and being configured to displace the locking bolt from a first position of the locking bolt corresponding to the second firing position, the cam being interlocked with the trigger, to a second position of the locking bolt corresponding to the second locking position, wherein the cam is not interlocked with the trigger, or vice versa;

the third elastic element being configured to displace the locking bolt from the second position of the locking bolt to the first position of the locking bolt, because the pusher expands the third elastic element from a second position of the third elastic element corresponding to the second position of the locking bolt, corresponding in turn to the second locking position, wherein the cam is not interlocked with the trigger, to a first position of the third elastic element corresponding to the first position of the locking bolt, corresponding in turn to the second firing position, wherein the cam is interlocked with the trigger, or vice versa;

the second safety further comprising an actuator, which carries out the expansion of the third elastic element from the second position of the third elastic element to the first position of the third elastic element, or vice versa.

16. A firearm comprising a safety device arranged in the firearm, wherein the firearm comprises:

a first safety that can be actuated by the user of the firearm, configured to be arranged in at least two positions: at least one first firing position and one first locking position;

a trigger that can be actuated by the user of the firearm configured to be released when the first safety is in the at least first firing position;

a hammer configured to be released when the trigger is actuated or kept actuated and the first safety is in the at least first firing position; and the safety device for firearms comprises a second safety that can be arranged in at least two positions, a second locking position and a second firing position, the second safety comprises a cam and a locking bolt, wherein:

in the second firing position the locking bolt is pressed against the cam and the cam is interlocked with the trigger, such that actuation of trigger releases the hammer; and in the second locking position the locking bolt is not pressed against the cam and the cam is not interlocked with the trigger, such that the hammer is locked by the trigger or the cam regardless of the position of the first safety.

17. A safety method for firearms, wherein the firearm comprises:

a first safety that can be actuated by the user of the firearm, configured to be arranged in at least two positions: at least one first firing position and one first locking position;

a trigger that can be actuated by the user of the firearm configured to be released when the first safety is in the at least first firing position;

a hammer configured to be released when the trigger is actuated or kept actuated and the first safety is in the at least first firing position;

a second safety that can be arranged in at least two positions, a second locking position and a second firing position, the second safety comprises a cam and a locking bolt, wherein the safety method for firearms comprises:

a stage for locking the hammer by the trigger or the cam, in the second locking position of the second safety in which the locking bolt is not pressed against the cam and the cam is not interlocked with the trigger, wherein in the second firing position of the second safety the locking bolt is pressed against the cam and the cam is interlocked with the trigger, such that actuation of trigger releases the hammer.

* * * * *